US012320572B2

(12) United States Patent
Ito et al.

(10) Patent No.: US 12,320,572 B2
(45) Date of Patent: Jun. 3, 2025

(54) REFRIGERATOR

(71) Applicant: Mitsubishi Electric Corporation, Tokyo (JP)

(72) Inventors: Takashi Ito, Tokyo (JP); Hiroaki Yokoo, Tokyo (JP); Tatsuya Umeda, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 161 days.

(21) Appl. No.: 18/259,429

(22) PCT Filed: Feb. 9, 2021

(86) PCT No.: PCT/JP2021/004742
§ 371 (c)(1),
(2) Date: Jun. 27, 2023

(87) PCT Pub. No.: WO2022/172317
PCT Pub. Date: Aug. 18, 2022

(65) Prior Publication Data

US 2024/0068732 A1 Feb. 29, 2024

(51) Int. Cl.
*F25D 17/04* (2006.01)

(52) U.S. Cl.
CPC ..... *F25D 17/045* (2013.01); *F25D 2700/02* (2013.01)

(58) Field of Classification Search
CPC ..... F25D 2700/02; F25D 2700/12; F25D 2600/06; F25D 17/045; F25D 11/02; F25B 2600/0251
See application file for complete search history.

(56) References Cited

U.S. PATENT DOCUMENTS 5,263,332 A * 11/1993 Park ..... F25D 29/00 62/157
6,044,654 A 4/2000 Igari et al.
(Continued)

FOREIGN PATENT DOCUMENTS

EP 3348940 A1 7/2018
JP H05-272854 A 10/1993
(Continued)

OTHER PUBLICATIONS

International Search Report of the International Searching Authority mailed Apr. 6, 2021 in corresponding international Patent Application No. PCT/JP2021/004742 (and English translation).

*Primary Examiner* — Nelson J Nieves
*Assistant Examiner* — Meraj A Shaikh
(74) *Attorney, Agent, or Firm* — Posz Law Group, PLC

(57) ABSTRACT

A refrigerator includes a controller wherein the controller detects opening and closing of a door during a normal temperature control in which a compartment temperature of a first storage compartment is maintained at a normal set temperature, to supply cold air to the first storage compartment for a first time period, in a case where the controller detects, via a temperature detection unit within the first time period, a temperature rise range equal to or more than a temperature rise range set in advance, cause the compartment temperature to shift to a first set temperature lower than the normal set temperature for a second time period and, thereafter, cause the compartment temperature to shift to a second set temperature higher than the normal set temperature for a third time period and then cause the compartment temperature to shift to the first set temperature for a fourth time period.

6 Claims, 7 Drawing Sheets

(56) References Cited

U.S. PATENT DOCUMENTS

| | | | | |
|---|---|---|---|---|
| 9,671,153 | B2 * | 6/2017 | Hagiwara | F25D 29/008 |
| 10,612,795 | B2 * | 4/2020 | Gagne | F24D 3/08 |
| 10,634,409 | B2 * | 4/2020 | Jin | B60H 1/00014 |
| 11,054,181 | B2 * | 7/2021 | Kim | F25D 11/02 |
| 2005/0115259 | A1 * | 6/2005 | Ergarac | F25D 29/00 62/229 |
| 2015/0377503 | A1 * | 12/2015 | Nakamoto | F24F 11/79 62/176.1 |
| 2017/0082335 | A1 * | 3/2017 | Jin | H04Q 9/00 |
| 2020/0363125 | A1 * | 11/2020 | Uchida | F25D 29/005 |

FOREIGN PATENT DOCUMENTS

| | | | |
|---|---|---|---|
| JP | H11-270952 | A | 10/1999 |
| JP | 2001-004260 | A | 1/2001 |
| JP | 2017-053583 | A | 3/2017 |
| JP | 2018-013263 | A | 1/2018 |
| JP | 2018-179469 | A | 11/2018 |
| SG | 11202104424 | A1 | 5/2021 |
| WO | 2020/144791 | A1 | 7/2020 |

* cited by examiner

REFRIGERATOR

CROSS REFERENCE TO RELATED APPLICATION

This application is a U.S. national stage application of PCT/JP2021/004742 filed on Feb. 9, 2021, the contents of which are incorporated herein by reference.

TECHNICAL FIELD

The present disclosure relates to a refrigerator having a storage compartment that is set to a soft freezing temperature zone.

BACKGROUND ART

In normal freezing performed in a conventional refrigerator, needle-like crystals are gradually formed from the surface of food toward the center. Therefore, there is an effect on food quality, such as deterioration of texture of thawed food caused by food cell destruction and outflow of umami or savoriness components. In view of the above, a refrigerator that performs freezing with improved freezing qualities has been proposed (see Patent Literature 1, for example).

In freezing disclosed in Patent Literature 1, after food is put into a compartment and the door is closed, the food is briefly introduced into a supercooled state, in which the food is not frozen even at a temperature equal to or less than the freezing point, and physical or temperature stimulation is then applied to the food having been introduced into the supercooled state. Here, the supercooled state refers to a state in which food is not frozen even after the food is cooled to a temperature equal to or lower than the freezing temperature of the food. When physical or temperature stimulation is applied to the food in the supercooled state, the supercooled state of the food is released, so that the food is quickly frozen. In the food that is frozen in this manner, ice nuclei are formed over the whole food, so that ice crystals of fine particles can be uniformly formed and hence, food cell destruction can be suppressed, thus suppressing deterioration of texture of thawed food, and umami components are maintained. Accordingly, even when food is frozen, it is possible to preserve the food in a high quality state.

CITATION LIST

Patent Literature

Patent Literature 1: Japanese Unexamined Patent Application Publication No. 2001-4260

SUMMARY OF INVENTION

Technical Problem

To freeze food after the food is more surely introduced into the supercooled state in the storage compartment set in a soft freezing temperature zone (for example, approximately −7 degrees C.), after the food is put into the compartment and the door is closed, it is necessary to briefly raise the compartment temperature to a temperature in the vicinity of the freezing point of the food and, thereafter, to lower the compartment temperature to a temperature equal to or lower than the freezing point of the food to prompt freezing of the food. However, in the conventional refrigerator disclosed in Patent Literature 1, after food is put into the compartment and the door is closed, the compartment temperature is lowered to the temperature equal to or lower than the freezing point without raising the compartment temperature to the temperature in the vicinity of the freezing point of the food. Therefore, there may be cases in which food is frozen without being introduced into the supercooled state, so that the food cannot be preserved in a high quality state. Further, in the case where high temperature food is put into the compartment in a soft freezing temperature zone, there is a problem that the temperature of food around the high temperature food rises, so that preservation quality of food may deteriorates. Alternatively, there is a problem that the temperature of the food that is put into the compartment is maintained in a refrigeration temperature zone (of temperatures equal to or higher than 0 degrees C.) for a long time period, so that preservation quality of food deteriorates.

The present disclosure has been made to overcome the above-mentioned problems, and it is an object of the present disclosure to provide a refrigerator that can preserve food in a high quality state with high precision.

Solution to Problem

A refrigerator according to an embodiment of the present disclosure includes: a heat insulating box body having a first storage compartment in the heat insulating box body, the first storage compartment being set to a soft freezing temperature zone; a door configured to open and close an opening formed at a front side of the first storage compartment; a door opening/closing detection unit configured to detect opening and closing of the door; a temperature detection unit configured to detect a compartment temperature of the first storage compartment; a temperature control unit configured to adjust the compartment temperature of the first storage compartment; and a controller configured to control the temperature control unit based on a detected temperature detected by the temperature detection unit, wherein the controller is configured to perform a special temperature control in which in a case where the controller detects the opening and closing of the door during a normal temperature control in which the compartment temperature of the first storage compartment is maintained at a normal set temperature set in advance, stop, for a first time period set in advance, supply of cold air by the temperature control unit to the first storage compartment, in a case where the controller detects, via the temperature detection unit within the first time period, a temperature rise range equal to or more than a temperature rise range set in advance, cause, by controlling the temperature control unit, the compartment temperature of the first storage compartment to shift to a first set temperature that is lower than the normal set temperature and that is set in advance, and maintain, by controlling the temperature control unit, the first set temperature for a second time period set in advance, after maintaining the first set temperature for the second time period, cause, by controlling the temperature control unit, the compartment temperature of the first storage compartment to shift to a second set temperature that is higher than the normal set temperature and that is set in advance, and maintain, by controlling the temperature control unit, the second set temperature for a third time period set in advance, and after maintaining the second set temperature for the third time period, cause, by controlling the temperature control unit, the compartment temperature of the first storage compartment to shift to the first set temperature, and maintain, by controlling the temperature control unit, the first set temperature for a fourth time period set in advance.

Advantageous Effects of Invention

In the refrigerator according to the embodiment of the present disclosure, the special temperature control is performed in which in a case where the opening and closing of the door is detected during the normal temperature control, in which the compartment temperature of the first storage compartment is maintained at the normal set temperature, the first storage compartment being set to the soft freezing temperature zone, and a specified temperature rise is detected in a state in which the adjustment of the temperature in the first storage compartment is stopped for the first time period, the compartment temperature of the first storage compartment is maintained for the second time period at the first set temperature, which is lower than the normal set temperature and, thereafter, the compartment temperature of the first storage compartment is maintained for the third time period at the second set temperature, which is higher than the normal set temperature, and the compartment temperature of the first storage compartment is then shifted to the first set temperature, and is maintained for the fourth time period. Therefore, even after high temperature food is put into the compartment and the door is closed, the food is briefly cooled down and, thereafter, is more surely introduced into the supercooled state and is then frozen and hence, it is possible to preserve the food in a high quality state with high precision.

DESCRIPTION OF EMBODIMENT

Hereinafter, an embodiment of the present disclosure will be described with reference to drawings. The present disclosure is not limited by the embodiment described below. The relationship of sizes of respective components in the following drawings may differ from that of the actual ones.

Embodiment 1

Figure 1:
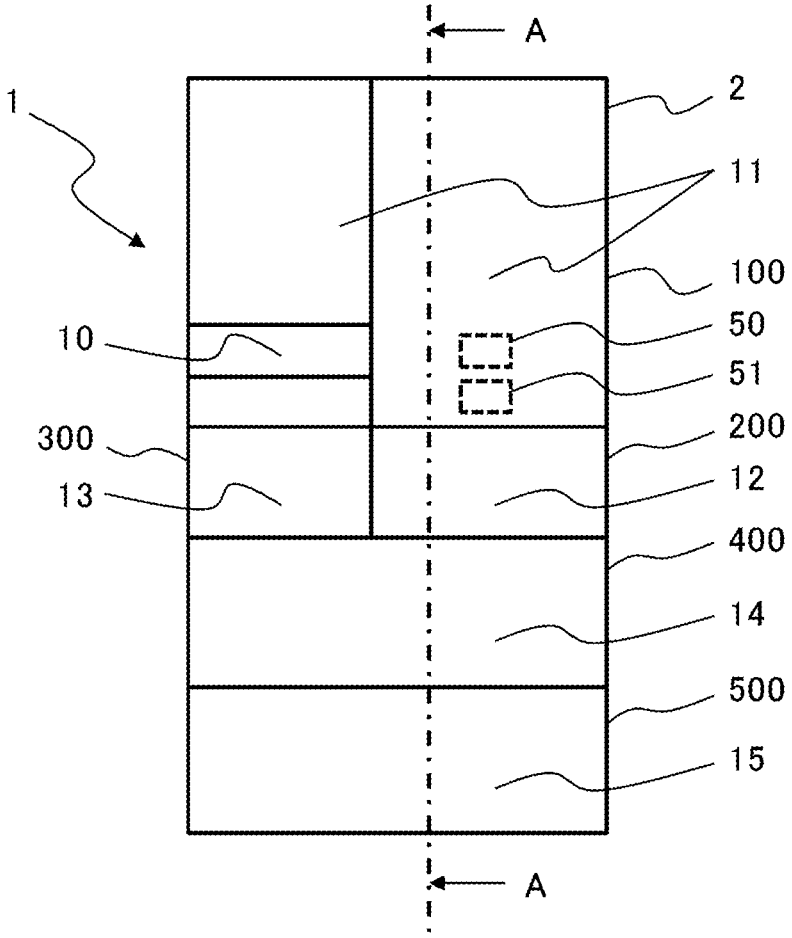
FIG. 1 is a front view of a refrigerator according to Embodiment 1.
Figure 2:
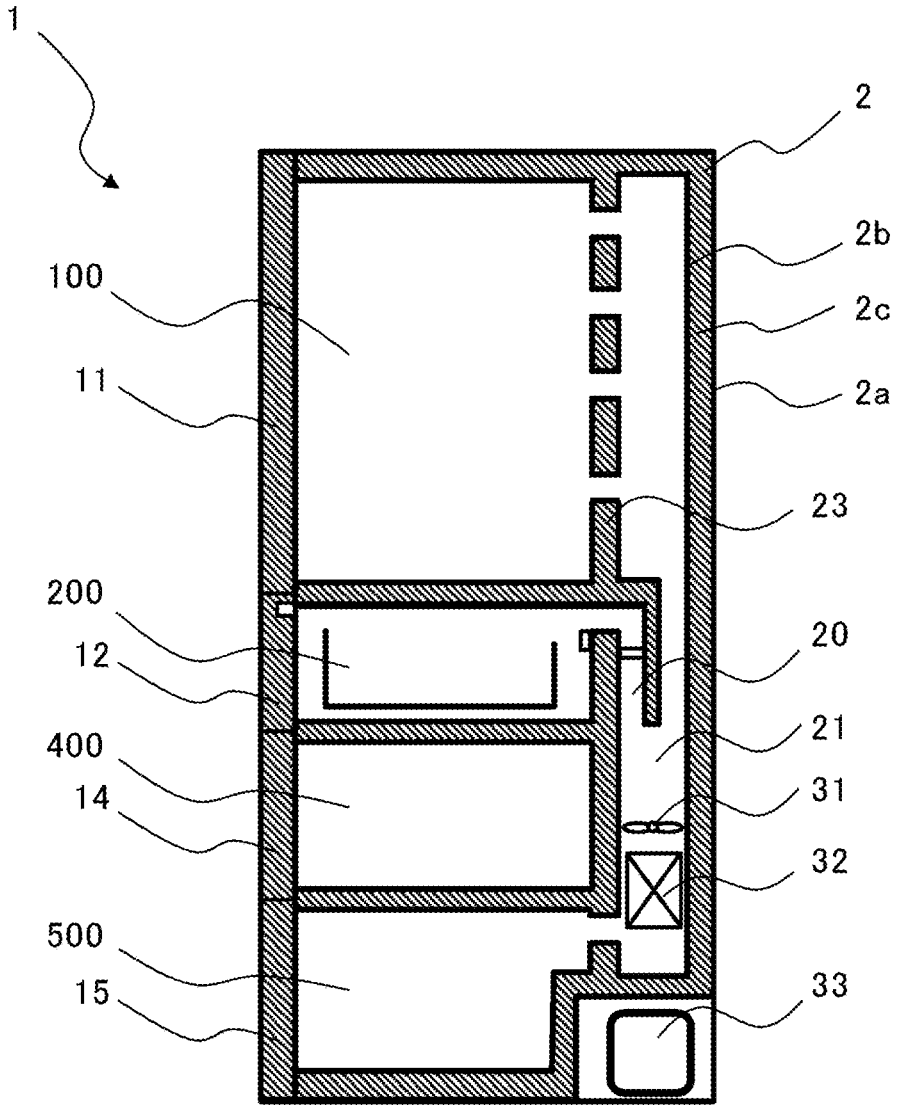
FIG. 2 is a longitudinal cross-sectional schematic view of the refrigerator according to Embodiment 1.
Figure 3:
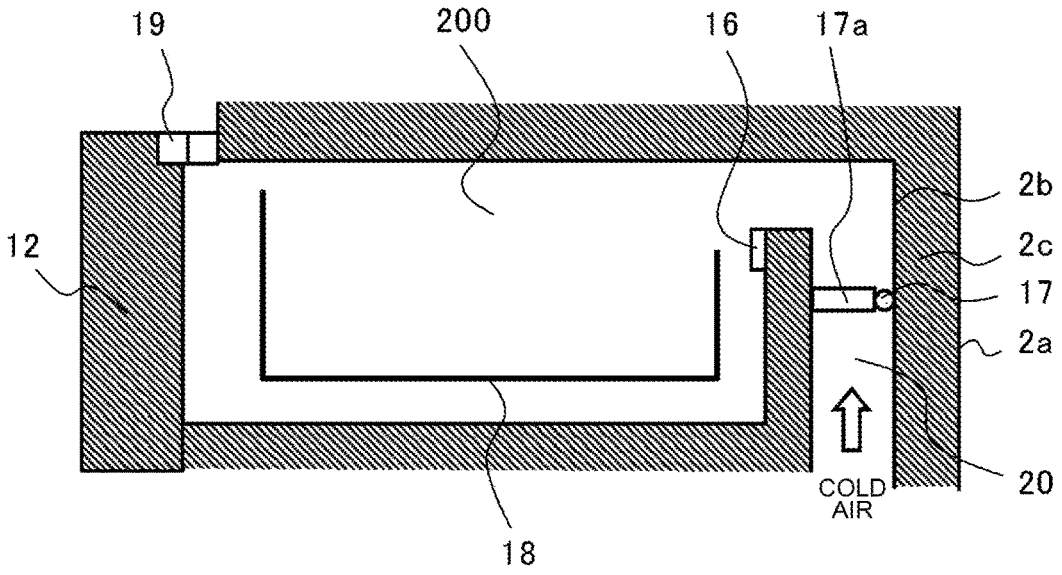
FIG. 3 is a longitudinal cross-sectional schematic view of a versatile compartment of the refrigerator according to Embodiment 1 and an area around the versatile compartment.

FIG. 1 is a front view of a refrigerator 1 according to Embodiment 1. FIG. 2 is a longitudinal cross-sectional schematic view of the refrigerator 1 according to Embodiment 1. FIG. 3 is a longitudinal cross-sectional schematic view of a versatile compartment 200 of the refrigerator 1 according to Embodiment 1 and an area around the versatile compartment 200. FIG. 2 is a cross-sectional schematic view taken along line A-A in FIG. 1.

The refrigerator 1 according to Embodiment 1 of the present disclosure includes a heat insulating box body 2 having an opening at the front side and having a storage space formed in the heat insulating box body 2. The heat insulating box body 2 is formed by filling a heat insulating material 2*c*, such as hard urethane foam, into a gap formed between an outer box 2*a* and an inner box 2*b*, the outer box 2*a* forming an outer contour and being made of a steel sheet, the inner box 2*b* being disposed inward of the outer box 2*a* and being made of a thin hard resin, such as an ABS resin.

The storage space formed in the heat insulating box body 2 is divided, by a plurality of partition parts (not shown in the drawing), into a plurality of storage compartments that preserve food. The refrigerator 1 according to Embodiment 1 has, as the plurality of storage compartments, a refrigerator compartment 100, the versatile compartment 200, and an ice-making compartment 300, the refrigerator compartment 100 being disposed at the uppermost stage, the versatile compartment 200 being disposed below the refrigerator compartment 100, the ice-making compartment 300 being disposed laterally adjacent to and side by side with the versatile compartment 200. The refrigerator 1 according to Embodiment 1 also has a vegetable compartment 400 and a freezer compartment 500, the vegetable compartment 400 being disposed below the versatile compartment 200 and the ice-making compartment 300, the freezer compartment 500 being disposed below the vegetable compartment 400, that is, being disposed at the lowermost stage.

Double refrigerator compartment doors 11 are provided to the opening that is formed at the front side of the refrigerator compartment 100, and the double refrigerator compartment doors 11 open and close the opening. A versatile compartment door 12 is provided to an opening formed at the front side of the versatile compartment 200, an ice-making compartment door 13 is provided to an opening formed at the front side of the ice-making compartment 300, a vegetable compartment door 14 is provided to an opening formed at the front side of the vegetable compartment 400, and a freezer compartment door 15 is provided to an opening formed at the front side of the freezer compartment 500, each door being a drawer door that opens and closes the corresponding opening, A setting operation unit 10 is provided to the refrigerator compartment door 11, and the setting operation unit 10 allows the user to perform operations, such as temperature setting for the respective storage compartments.

The refrigerator compartment 100 is set to a refrigeration temperature zone (for example, approximately 3 degrees C.). The versatile compartment 200 is set to a freezing temperature zone (for example, approximately −18 degrees C.) or a soft freezing temperature zone (for example, approximately −7 degrees C.) by performing switching. The ice-making compartment 300 is set to the freezing temperature zone (for example, approximately −18 degrees C.). The vegetable compartment 400 is set to a refrigeration temperature zone (for example, approximately 6 degrees C.). The freezer compartment 500 is set to the freezing temperature zone (approximately −18 degrees C.). Here, it is sufficient that the soft freezing temperature zone be temperatures that fall within a range from −4 degrees C. to −10 degrees C.

The arrangement of the respective storage compartments is not limited to the arrangement described in Embodiment 1, and an arrangement other than the above-mentioned arrangement may be adopted. Further, the number of storage compartments is not limited to the number of storage compartments described in Embodiment 1, and it is sufficient that the refrigerator 1 at least has a storage compartment that can be set to the soft freezing temperature zone.

A food accommodation case 18 is installed in each storage compartment, and accommodates food. Each door is provided with a door opening/closing detection unit 19 that detects the opening and closing of the door.

As shown in FIG. 2, a cooling chamber 21 is formed in the heat insulating box body 2 at a position close to the back side, and the inside of the heat insulating box body 2 is divided into the respective storage compartments and the cooling chamber 21 by a partition plate 23. A blower fan 31, a cooler 32 and the like are disposed in the cooling chamber 21. The refrigerator 1 is configured such that cold air cooled by the cooler 32 is fed into the respective storage compartments from the cooling chamber 21 by the blower fan 31, thus cooling the respective storage compartments. The heat insulating box body 2 has an air passage 20 that communicates the cooling chamber 21 with the versatile compartment 200 to feed cold air cooled by the cooler 32 into the versatile compartment 200.

As shown in FIG. 3, a damper device 17 is disposed in the air passage 20 through which cold air cooled by the cooler 32 passes when the cold air is fed into the respective storage compartments from the cooling chamber 21. The damper device 17 includes a damper 17*a* that opens and closes the air passage 20 with the control from a controller 50 and, by opening or closing the damper 17*a*, the damper device 17 adjusts the volume of cold air that flows through the air passage 20.

A temperature detection unit 16, such as a thermistor, is provided to each storage compartment. Based on the detected temperature detected by the temperature detection unit 16, the controller 50 controls a temperature control unit 30 such that each storage compartment is maintained at a set temperature. Specifically, based on the detected temperature detected by the temperature detection unit 16, the controller 50 controls the opening degree of the damper device 17, the output of a compressor 33, and the air supply volume of the blower fan 31. The damper device 17, the compressor 33, and the blower fan 31 form the temperature control unit 30. The temperature control unit 30 is a temperature adjustment device that adjusts a compartment temperature of a storage compartment.

Figure 4:
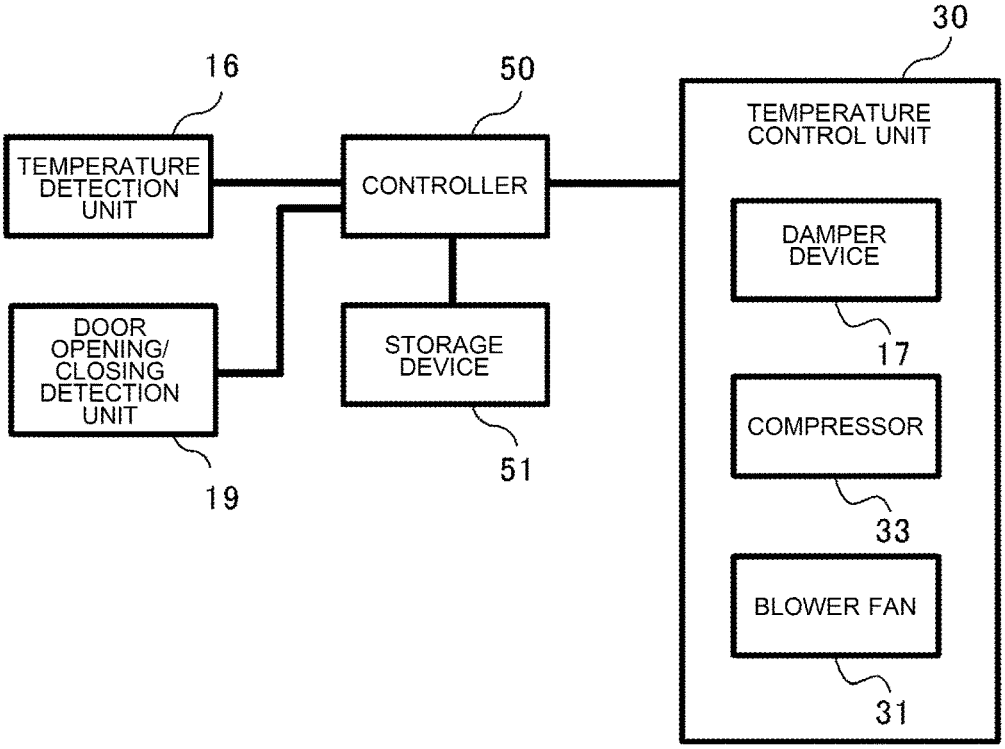
FIG. 4 is a block diagram relating to a control performed by a controller of the refrigerator according to Embodiment 1.

FIG. 4 is a block diagram relating to a control performed by the controller 50 of the refrigerator 1 according to Embodiment 1. The controller 50 and a storage device 51 are provided in the refrigerator 1. The controller 50 controls the temperature control unit 30 based on the detected temperature detected by the temperature detection unit 16. The controller 50 also controls the temperature control unit 30 based on the detection of the open/closed state of the door, which is detected by the door opening/closing detection unit 19.

The controller 50 is, for example, dedicated hardware or a central processing unit (also referred to as a CPU, a processing unit, an arithmetic unit, a microprocessor, or a processor) that executes a program stored in a memory.

The storage device 51 stores various pieces of information. The storage device 51 is, for example, an EEPROM, a flash memory or the like. The storage device 51 stores a normal set temperature, a first set temperature, a second set temperature, a first time period, a second time period, a third time period, a fourth time period, a first standby time period, a temperature setting range and the like, which will be described later. The controller 50 utilizes such data stored in the storage device 51 in advance as necessary.

Each of the above-described normal set temperature, first set temperature, and second set temperature is in a freezing temperature zone of temperatures equal to or less than 0 degrees C. Assume that the second set temperature is a temperature that is higher than the upper limit of the hunting range of the normal set temperature and that falls within the range from −5 degrees C. to 0 degrees C., being equal to or higher than the freezing start temperature of food. Assume that the first set temperature is a temperature lower than the lower limit of the hunting range of the normal set temperature.

Next, the description will be made for control of a compartment temperature of the versatile compartment 200 that is set in the soft freezing temperature zone (−7 degrees C.) by performing switching. The versatile compartment 200 corresponds to a first storage compartment.

Figure 5:
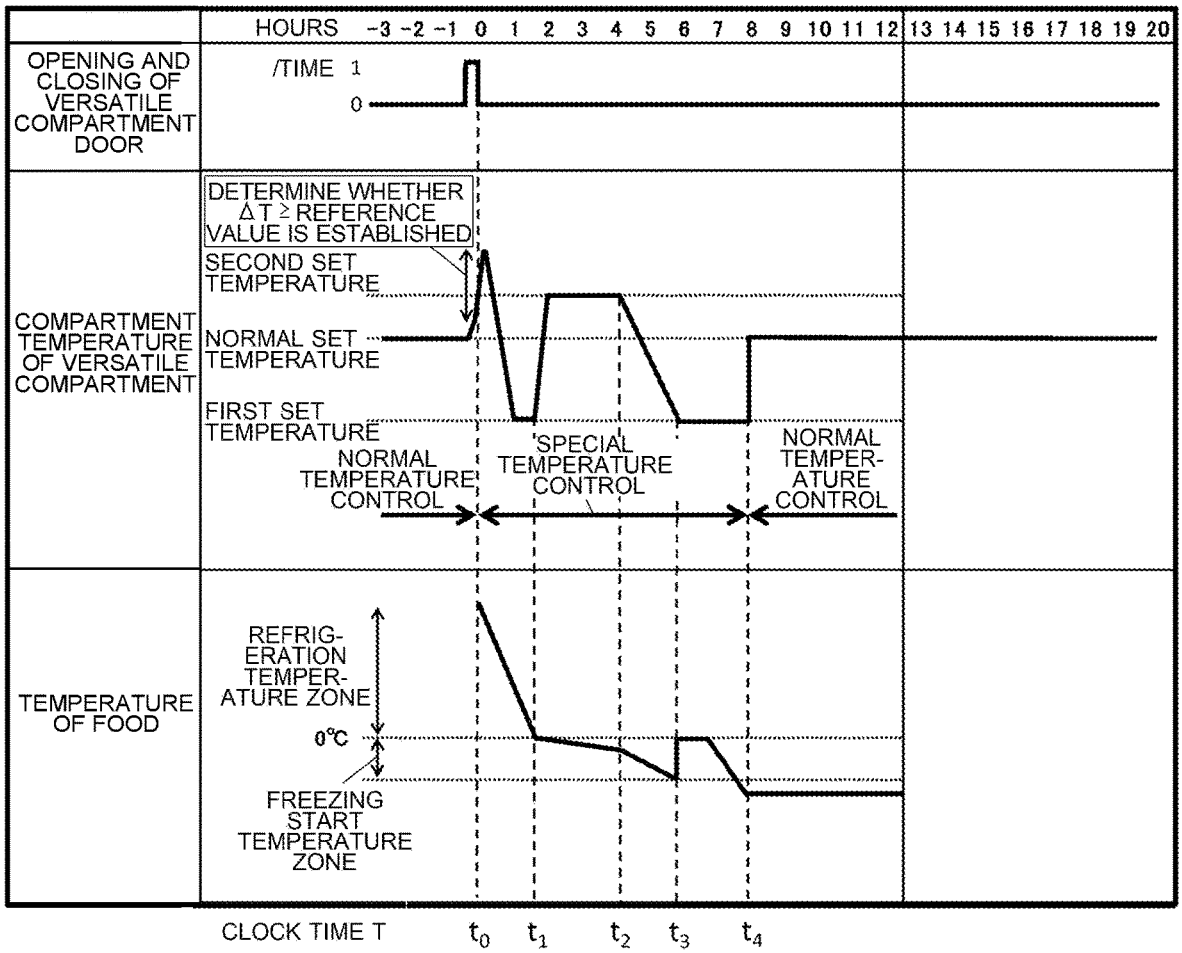
FIG. 5 is a diagram showing temporal transition of the compartment temperature of the versatile compartment in the case where the opening and closing of a versatile compartment door of the refrigerator according to Embodiment 1 is performed during a normal temperature control and high temperature food is put into the versatile compartment.
Figure 6:
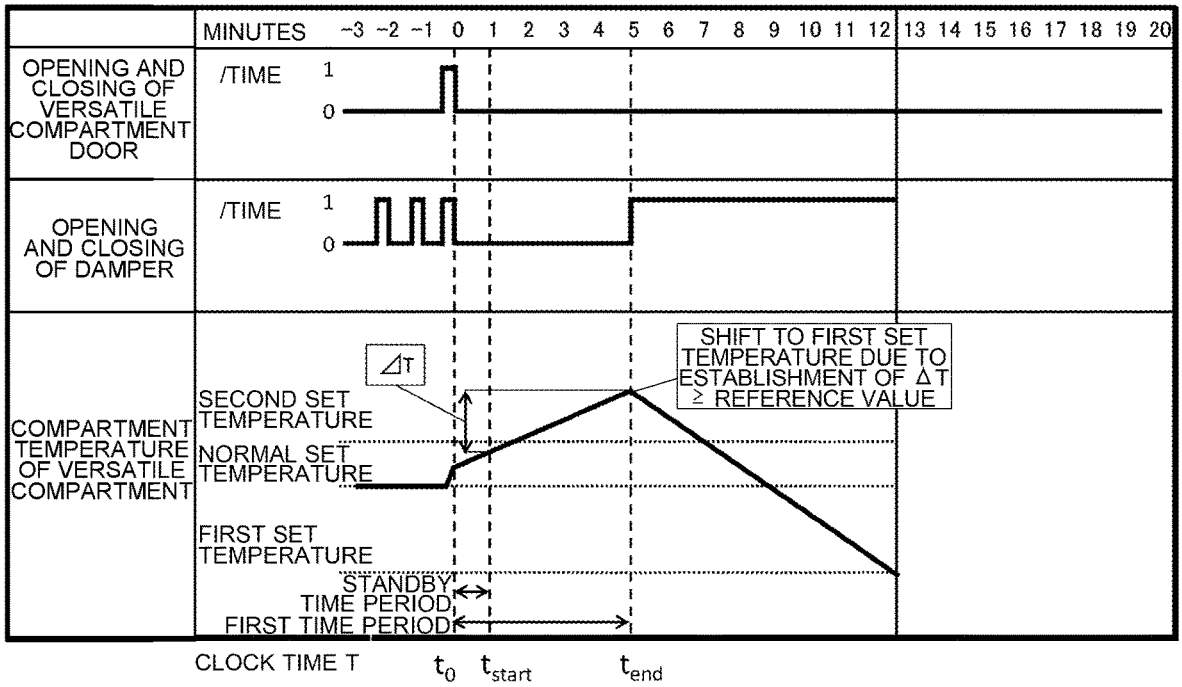
FIG. 6 is a diagram showing temporal transition of the opening and closing of a damper and the compartment temperature of the versatile compartment in the case where the opening and closing of the versatile compartment door of the refrigerator according to Embodiment 1 is performed during the normal temperature control and immediately after high temperature food is put into the versatile compartment.

FIG. 5 is a diagram showing temporal transition of the compartment temperature of the versatile compartment 200 in the case where the opening and closing of the versatile compartment door 12 of the refrigerator 1 according to Embodiment 1 is performed during a normal temperature control and high temperature food is put into the versatile compartment 200. FIG. 6 is a diagram showing temporal transition of the opening and closing of the damper 17*a* and the compartment temperature of the versatile compartment 200 in the case where the opening and closing of the versatile compartment door 12 of the refrigerator 1 according to Embodiment 1 is performed during the normal temperature control and immediately after high temperature food is put into the versatile compartment 200. A special temperature control of the refrigerator 1 will be described with reference to FIG. 5 and FIG. 6.

FIG. 5 shows temporal transition of the compartment temperature of the versatile compartment 200 in the case where high temperature food is put into the versatile compartment 200. In FIG. 5, the time period unit is "hours". FIG. 6 is a diagram showing, in an enlarged manner, a time zone in FIG. 5 ranging from the detection of the opening and closing of the versatile compartment door 12 by the controller 50 to the shift of the compartment temperature of the versatile compartment 200 to the first set temperature. In FIG. 6, the time period unit is "minutes". FIG. 5 and FIG. 6 show the relationship between the opening and closing of the damper 17*a* of the damper device 17 and the compartment temperature of the versatile compartment 200 in the temporal transition assuming that the dock time at which the controller 50 detects a signal indicating the closure of the versatile compartment door 12 is $t_0$ (dock time $T=t_0=0$ (hours)). FIG. 6 shows a section between around dock time $T=t_0$ and dock time $T=t_1$ in FIG. 5.

First, control of the compartment temperature of the versatile compartment 200 in the case where the opening and closing of the versatile compartment door 12 is performed during the normal temperature control will be described with reference to FIG. 5 and FIG. 6. Here, the normal temperature control refers to a control in which the compartment temperature of the versatile compartment 200 is maintained at the normal set temperature (for example, approximately −7 degrees C.) by controlling the temperature control unit 30. The normal temperature control is performed by mainly controlling the opening and closing of the damper 17*a* of the damper device 17. In the case of compositely controlling the respective compartments, the normal temperature control may be performed by controlling the compressor 33 or the blower fan 31. The opening and closing of the versatile compartment door 12 refers to bringing the versatile compartment door 12 into a closed state from an open state. The compartment temperature of the versatile compartment 200 is detected by the temperature detection unit 16, and the controller 50 receives a signal relating to the temperature detected by the temperature detection unit 16. The normal set temperature is set in advance, and is stored in the storage device 51.

In the case where the controller 50 detects the opening and closing of the versatile compartment door 12 during the normal temperature control based on the signal received from the door opening/closing detection unit 19, by controlling the temperature control unit 30, the controller 50 brings the damper 17*a* of the damper device 17 into a closed state for the first time period (for example, approximately 5 minutes) as shown in FIG. 6 to stop supply of cold air. In other words, the controller 50 stops, for the first time period, the adjustment of the temperature of the versatile compartment 200 performed by the temperature control unit 30. Assume that the dock time at which the controller 50 detects a signal is $t_0$ (clock time $T=t_0$), the signal being received from the door opening/closing detection unit 19 and indicating the closure of the versatile compartment door 12. The first time period refers to a time period ranging from clock time $T=t_0$ to clock time $T=t_{end}$ in FIG. 6. The first time period is set in advance, and is stored in the storage device 51.

After the controller 50 detects the opening and closing of the versatile compartment door 12, the controller 50 detects the compartment temperature of the versatile compartment 200 via the temperature detection unit 16 for a time period ranging from a point of time after the lapse of the first standby time period (for example, approximately 1 minute) (clock time $T=t_{start}$) to the end of the first time period (clock time $T=t_{end}$). When the controller 50 detects a temperature rise range ($\Delta T$) equal to or more than a temperature rise range set in advance, the controller 50 brings the damper 17*a* of the damper device 17 into an open state by controlling the temperature control unit 30. Then, the controller 50 causes the compartment temperature of the versatile compartment 200 to shift to the first set temperature (for example, approximately −12 degrees C.), which is lower than the normal set temperature, which is set for the case in which there is no opening and closing of the versatile compartment door 12. Temperature control is performed by mainly controlling the opening and closing of the damper 17*a* of the damper device 17. In the case where a temperature is maintained for a long time period or the case in which the respective compartments are compositely controlled, temperature control may be performed by controlling the compressor 33 or the blower fan 31. The first standby time period is set in advance, and is stored in the storage device 51. The first set temperature and the temperature rise range set in advance are specified values, and are stored in the storage device 51.

After the compartment temperature of the versatile compartment 200 is shifted to the first set temperature, the controller 50 maintains the first set temperature for the second time period (for example, approximately 30 minutes) by repeating the opening and closing of the damper 17*a* by controlling the temperature control unit 30 such that the first set temperature is maintained. The second time period refers to a time period ranging from clock time $T=t_{end}$ in FIG. 6 to clock time $T=t_1$ in FIG. 5. The second time period is set in advance, and is stored in the storage device 51.

Thereafter (after clock time $T=t_1$), by controlling the temperature control unit 30, the controller 50 closes the damper 17*a* to raise the compartment temperature of the versatile compartment 200, thus causing the compartment temperature of the versatile compartment 200 to shift to the second set temperature (approximately −4 degrees C.), which is higher than the normal set temperature. Temperature control is performed by mainly controlling the opening and closing of the damper 17*a* of the damper device 17. In the case where a temperature is maintained for a long time period or the case in which the respective compartments are compositely controlled, temperature control may be performed by controlling the compressor 33 or the blower fan 31. After the compartment temperature of the versatile compartment 200 is shifted to the second set temperature, the controller 50 maintains the second set temperature for the third time period (for example, approximately 1.5 hours) by repeating the opening and closing of the damper 17*a* by controlling the temperature control unit 30 such that the second set temperature is maintained. The third time period refers to a time period ranging from clock time $T=t_1$ to clock time $T=t_2$ in FIG. 5. The second set temperature and the third time period are set in advance, and are stored in the storage device 51. At this point of operation, the compartment temperature (even the second set temperature) is lower than the temperature of food and hence, the temperature of the food does not rise.

Further thereafter (after clock time $T=t_2$), by controlling the temperature control unit 30, the controller 50 brings the damper 17*a* of the damper device 17 into an open state to cause the compartment temperature of the versatile compartment 200 to shift to the first set temperature (approximately −12 degrees C.), which is lower than the normal set temperature. Temperature control is performed by mainly controlling the opening and closing of the damper 17*a* of the damper device 17. In the case where a temperature is maintained for a long time period or the case in which the respective compartments are compositely controlled, temperature control may be performed by controlling the compressor 33 or the blower fan 31. Assume that the clock time at which the compartment temperature of the versatile compartment 200 is shifted to the first set temperature is $t_3$ (clock time $T=t_3$).

Here, shifting from the second set temperature to the normal set temperature is performed by spending approximately 2.5 hours, That is, during such shifting, the inside of the versatile compartment 200 is gradually cooled. Shifting from the normal set temperature to the first set temperature is performed by spending approximately 10 minutes. That is, during such shifting, the inside of the versatile compartment 200 is rapidly cooled, Although the temperature (of air) in the compartment rapidly decreases by performing "rapid cooling", food has a large heat capacity and hence, the temperature of the food does not rapidly decrease. A difference between gradual cooling and rapid cooling lies in the adjustment of the opening degree of the damper 17*a*, for example. In performing rapid cooling, the controller 50 may set a larger opening degree of the damper 17*a* than in performing gradual cooling. In performing "gradual cooling" or "rapid cooling", frequency of the opening and chasing of the damper 17*a* or the length of the open time period (the ratio of opening within a certain time period) is mainly adjusted by the controller 50. When rapid cooling is desired, the controller 50 maintains the open state of the damper 17*a*, When gradual cooling is desired, the opening and closing of the damper 17*a* is repeated and an open time period is shortened. In performing "rapid cooling", the controller 50 may speed up the operation of the compressor 33, or may increase the rotation speed of the blower fan 31.

The larger the difference between the temperature of food that is put into the compartment, the temperature in the compartment causes the food to be cooled more rapidly. Therefore, when the temperature in the compartment is raised to the second set temperature, the difference between the temperature of food and the temperature in the compartment decreases and hence, it is possible to slowly cool the food. The controller 50 introduces the food into a supercooled state by slowly cooling (gradually cooling) the food. Thereafter, by decreasing the temperature in the compartment, the food is rapidly cooled and the supercooled state becomes more unstable (becomes more likely to be released) as the temperature of the food decreases. When the temperature of the food reaches a temperature equal to or less than a certain temperature, the supercooled state is released even with low stimulation. The controller 50 achieves the releasing of the supercooled state of food and the introduction into a cooled state by lowering the temperature in the compartment from the second set temperature to the first set temperature.

After the temperature in the compartment is shifted to the first set temperature, the controller 50 maintains the first set temperature for the fourth time period (for example, approximately 2 hours) by repeating the opening and closing of the damper 17*a* by controlling the temperature control unit 30 such that the first set temperature is maintained. Temperature control is performed by mainly controlling the opening and closing of the damper 17*a* of the damper device 17. In the case where a temperature is maintained for a long time period or the case in which the respective compartments are compositely controlled, temperature control may be performed by controlling the compressor 33 or the blower fan 31. The fourth time period refers to a time period ranging from clock time $T=t_3$ to clock time $T=t_4$ in FIG. 5. The fourth time period is set in advance, and is stored in the storage device 51.

Further thereafter (after clock time $T=t_4$), until the controller 50 detects the opening and closing of the versatile compartment door 12 based on a signal received from the door opening/closing detection unit 19, the controller 50 maintains the temperature in the versatile compartment 200 at the normal set temperature by controlling the temperature control unit 30. Temperature control is performed by mainly controlling the opening and closing of the damper 17*a* of the damper device 17. In the case where a temperature is maintained for a long time period or the case in which the respective compartments are compositely controlled, temperature control may be performed by controlling the compressor 33 or the blower fan 31. Food has a large heat capacity and hence, there is no possibility of an extreme rise in the temperature of the food.

Figure 7:
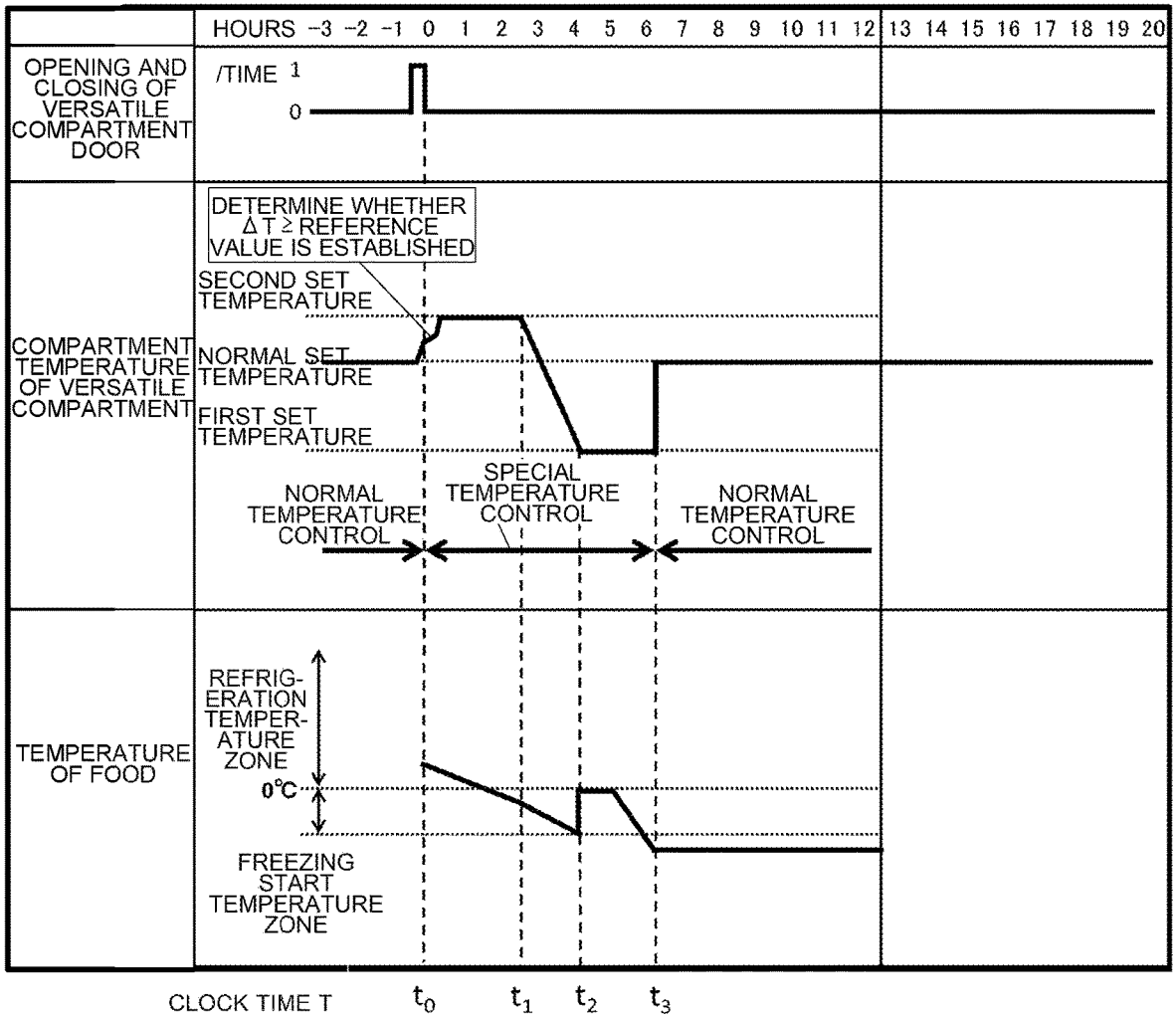
FIG. 7 is a diagram showing temporal transition of the compartment temperature of the versatile compartment in the case where the opening and closing of the versatile compartment door of the refrigerator according to Embodiment 1 is performed during the normal temperature control and low temperature food is put into the versatile compartment.
Figure 8:
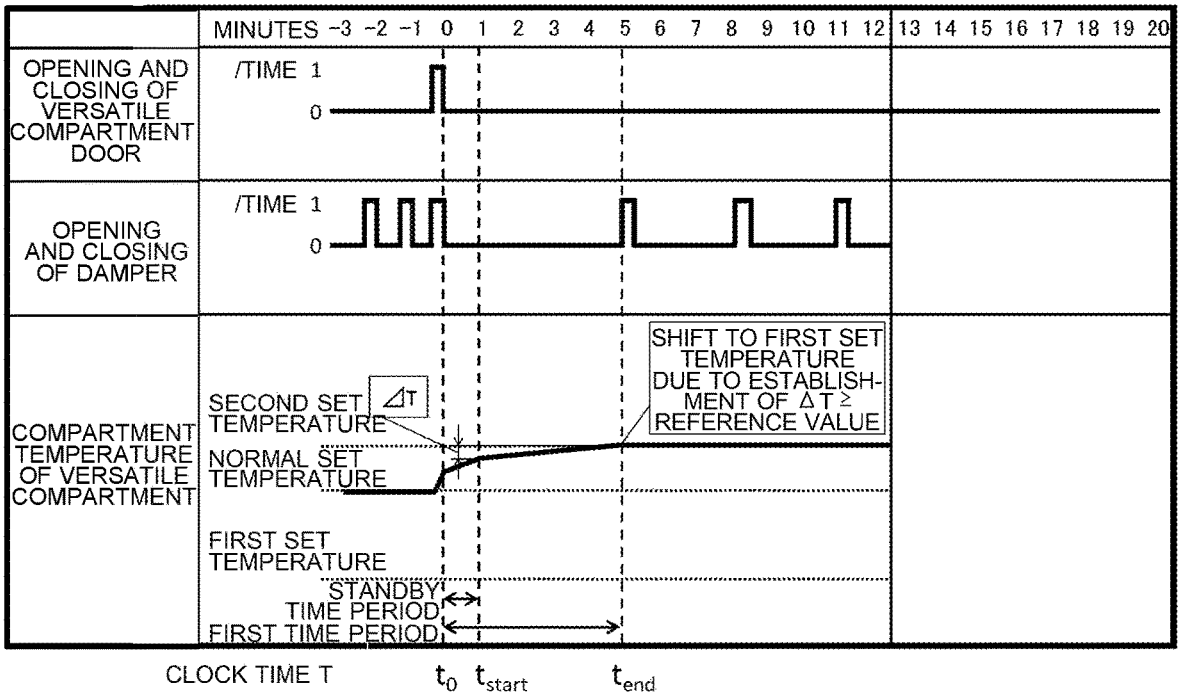
FIG. 8 is a diagram showing temporal transition of the opening and closing of the damper and the compartment temperature of the versatile compartment in the case where the opening and closing of the versatile compartment door of the refrigerator according to Embodiment 1 is performed during the normal temperature control and immediately after low temperature food is put into the versatile compartment.

FIG. 7 is a diagram showing temporal transition of the compartment temperature of the versatile compartment 200 in the case where the opening and closing of the versatile compartment door 12 of the refrigerator 1 according to Embodiment 1 is performed during the normal temperature control and low temperature food is put into the versatile compartment 200. FIG. 8 is a diagram showing temporal transition of the opening and closing of the damper 17*a* and the compartment temperature of the versatile compartment 200 in the case where the opening and closing of the versatile compartment door 12 of the refrigerator 1 according to Embodiment 1 is performed during the normal temperature control and immediately after low temperature food is put into the versatile compartment 200. A special temperature control of the refrigerator 1 will be described with reference to FIG. 7 and FIG. 8.

FIG. 7 shows temporal transition of the compartment temperature of the versatile compartment 200 in the case where low temperature food is put into the versatile compartment 200. In FIG. 7, the time period unit is "hours". FIG. 8 is a diagram showing, in an enlarged manner, a time zone in FIG. 7 ranging from the detection of the opening and closing of the versatile compartment door 12 by the controller 50 to the shift of the compartment temperature of the versatile compartment 200 to the second set temperature. In FIG. 6, the time period unit is "minutes". FIG. 7 and FIG. 8 show the relationship between the opening and closing of the damper 17*a* of the damper device 17 and the compartment temperature of the versatile compartment 200 in the temporal transition assuming that the clock time at which the controller 50 detects a signal indicting the closure of the versatile compartment door 12 is to (clock time $T=t_0=0$ (hours)). FIG. 8 shows a section between around dock time $T=t_0$ and dock time $T=t_1$ in FIG. 7.

In the case where the controller 50 detects the opening and closing of the versatile compartment door 12 during the normal temperature control based on the signal received from the door opening/closing detection unit 19, by controlling the temperature control unit 30, the controller 50 brings the damper 17*a* of the damper device 17 into a closed state for the first time period (for example, approximately 5 minutes) as shown in FIG. 8. In other words, the controller 50 stops, for the first time period, the adjustment of the temperature of the versatile compartment 200 performed by the temperature control unit 30. Assume that the clock time at which the controller 50 detects a signal is to (clock time $T=t_0$), the signal being received from the door opening/closing detection unit 19 and indicating the closure of the versatile compartment door 12. The first time period refers to a time period ranging from clock time $T=t_0$ to clock time $T=t_{end}$ in FIG. 8.

After the controller 50 detects the opening and closing of the versatile compartment door 12, the controller 50 detects the compartment temperature of the versatile compartment 200 via the temperature detection unit 16 for a time period ranging from a point of time after the lapse of the first standby time period (for example, approximately 1 minute) (clock time $T=t_{start}$) to the end of the first time period (clock time $T=t_{end}$). When the controller 50 detects no temperature rise range ($\Delta T$) equal to or more than the temperature rise range set in advance, the controller 50 does not control the temperature control unit 30, and maintains the closed state of the damper 17*a* of the damper device 17.

By maintaining the closed state of the damper 17*a*, the controller 50 causes the compartment temperature of the versatile compartment 200 to shift to the second set temperature (approximately −4 degrees C.), which is higher than the normal set temperature. Temperature control is performed by mainly controlling the opening and closing of the damper 17*a* of the damper device 1T In the case where a temperature is maintained for a long time period or the case in which the respective compartments are compositely controlled, temperature control may be performed by controlling the compressor 33 or the blower fan 31. The controller 50 maintains the second set temperature for the third time period (for example, approximately 1.5 hours) by repeating the opening and closing of the damper 17*a* by controlling the temperature control unit 30 such that the second set temperature is maintained. The third time period refers to a time period ranging from clock time $T=t_{end}$ in FIG. 8 to clock time $T=t_1$ in FIG. 7. At this point of operation, the compartment temperature of the versatile compartment 200 (even the second set temperature) is lower than the temperature of food and hence, the temperature of the food does not rise.

Further thereafter (after clock time $T=t_1$), by controlling the temperature control unit 30, the controller 50 brings the damper 17*a* of the damper device 17 into an open state to cause the compartment temperature of the versatile compartment 200 to shift to the first set temperature (approximately −12 degrees C.), which is lower than the normal set temperature. Temperature control is performed by mainly controlling the opening and closing of the damper 17*a* of the damper device 17. In the case where a temperature is maintained for a long time period or the case in which the respective compartments are compositely controlled, temperature control may be performed by controlling the compressor 33 or the blower fan 31. Assume that the clock time at which the compartment temperature of the versatile compartment 200 is shifted to the first set temperature is $t_2$ (clock time $T=t_2$). Accordingly, a shifting time period from the second set temperature to the first set temperature is a time period ranging from clock time $T=T_1$ to clock time $T=T_2$.

Here, shifting from the second set temperature to the normal set temperature is performed by spending approximately 2.5 hours. That is, during such shifting, the inside of the versatile compartment 200 is gradually cooled. Shifting from the normal set temperature to the first set temperature is performed by spending approximately 10 minutes. That is, during such shifting, the inside of the versatile compartment 200 is rapidly cooled, Although the temperature (of air) in the compartment rapidly decreases by performing "rapid cooling", food has a large heat capacity and hence, the temperature of the food does not rapidly decrease. A difference between gradual cooling and rapid cooling lies in the adjustment of the opening degree of the damper 17*a*, for example. In performing rapid cooling, the controller 50 may set a larger opening degree of the damper 17*a* than in performing gradual cooling. In performing "gradual cooling" or "rapid cooling", frequency of the opening and closing of the damper 17*a* or the length of the open time period (the ratio of opening within a certain time period) is mainly adjusted by the controller 50. When rapid cooling is desired, the controller 50 maintains the open state of the damper 17*a*. When gradual cooling is desired, the opening and closing of the damper 17*a* is repeated and an open time period is shortened. In performing "rapid cooling", the controller 50 may speed up the operation of the compressor 33, or may increase the rotation speed of the blower fan 31.

The larger the difference between the temperature of food that is put into the compartment, the temperature in the compartment causes the food to be cooled more rapidly. Therefore, when the temperature in the compartment is raised to the second set temperature, the difference between the temperature of food and the temperature in the compartment decreases and hence, it is possible to slowly cool food. The controller 50 introduces the food into the supercooled state by slowly cooling (gradually cooling) the food. Thereafter, by decreasing the temperature in the compartment, the food is rapidly cooled and the supercooled state becomes more unstable (becomes more likely to be released) as the temperature of the food decreases. When the temperature of the food reaches a temperature equal to or less than a certain temperature, the supercooled state is released even with low stimulation. The controller 50 achieves the releasing of the supercooled state of food and the introduction into a cooled state by lowering the temperature in the compartment from the second set temperature to the first set temperature.

After the temperature in the compartment is shifted to the first set temperature (after dock time $T=t_2$), the controller 50 maintains the first set temperature for the fourth time period (for example, approximately 2 hours) by repeating the opening and closing of the damper 17*a* by controlling the temperature control unit 30 such that the first set temperature is maintained. Temperature control is performed by mainly controlling the opening and closing of the damper 17*a* of the damper device 17. In the case where a temperature is maintained for a long time period or the case in which the respective compartments are compositely controlled, temperature control may be performed by controlling the compressor 33 or the blower fan 31. The fourth time period refers to a time period ranging from dock time $T=t_2$ to dock time $T=t_3$ in FIG. 7.

Further thereafter (after dock time $T=t_3$), until the controller 50 detects the opening and closing of the versatile compartment door 12 based on a signal received from the door opening/closing detection unit 19, the controller 50 maintains the temperature in the versatile compartment 200 at the normal set temperature by controlling the temperature control unit 30. Temperature control is performed by mainly controlling the opening and closing of the damper 17*a* of the damper device 17. In the case where a temperature is maintained for a long time period or the case in which the respective compartments are compositely controlled, temperature control may be performed by controlling the compressor 33 or the blower fan 31. Food has a large heat capacity and hence, there is no possibility of an extreme rise in the temperature of the food.

As described above, in the case where high temperature food is put into the versatile compartment 200, when the controller 50 detects a temperature rise ($\Delta T$) with a temperature range equal to or greater than a temperature range of a specified value (for example, a temperature rise range of approximately 2 degrees C.) within the first time period after the detection of the opening and closing of the versatile compartment door 12, the controller 50 performs the following special temperature control: The controller 50 maintains the compartment temperature of the versatile compartment 200 at the first set temperature for the second time period. Thereafter, the controller 50 maintains the compartment temperature of the versatile compartment 200 at the second set temperature for the third time period. Further thereafter, the controller 50 maintains the compartment temperature of the versatile compartment 200 at the first set temperature for the fourth time period. Therefore, even after high temperature food is put into the compartment and the door is closed, the food is briefly cooled down and thereafter, is more surely introduced into the supercooled state and is then frozen and hence, it is possible to preserve the food in a high quality state with high precision.

In the case where low temperature food is put into the versatile compartment 200, when the controller 50 detects no temperature rise (ST) with a temperature range equal to or more than a temperature range of the specified value within the first time period after the detection of the opening and closing of the versatile compartment door 12, the controller 50 performs the following special temperature control: The controller 50 maintains the compartment temperature of the versatile compartment 200 at the second set temperature for the third time period. Further thereafter, the controller 50 maintains the compartment temperature of the versatile compartment 200 at the first set temperature for the fourth time period. Therefore, even after food is put into the compartment and the door is closed, the food is briefly cooled down and thereafter, is more surely introduced into the supercooled state and is then frozen and hence, it is possible to preserve the food in a high quality state with high precision.

The controller 50 performs the special temperature control when the controller 50 detects a temperature rise of a temperature equal to or higher than a specified temperature within the first time period after the detection of the opening and closing of the versatile compartment door 12 and hence, a temperature control of the compartment can be started simultaneously with high temperature food being put into the versatile compartment 200. Thus, the food is preserved at the first set temperature immediately after being put into the versatile compartment 200 and hence, the food is more quickly cooled than the case in which the food is preserved at the normal set temperature.

Particularly, the temperature of food passes through the refrigeration temperature zone (of temperatures equal to or higher than 0 degrees C.) in a short time period, the refrigeration temperature zone having an effect on the solidification of starch that occurs in rice or the like. Accordingly, the refrigerator 1 can preserve, in a high quality state, food, such as rice, that is preserved in the versatile compartment 200. In addition to the above, the temperature of food preserved in the versatile compartment 200 passes through a high temperature range (for example, of temperatures equal to or higher than 70 degrees C.) in a short time period. Accordingly, the refrigerator 1 can suppress an effect on preservation quality, such as thawing food around the food to be newly preserved in the versatile compartment 200. Further, after the temperature of food passes through the refrigeration temperature zone, the food is preserved at a temperature that falls within the range from −5 degrees C. to 0 degrees C., being equal to or higher than the freezing start temperature, and hence, it is possible to introduce food into the supercooled state with high precision. Here, the supercooled state refers to a state in which the food is not frozen even after the food is cooled to a temperature equal to or lower than the freezing temperature of the food.

Further, by preserving food at the second set temperature for the third time period, and then by preserving the food at the first set temperature, the supercooled state of the food is released and, after freezing starts, the food is cooled more rapidly than the case in which food is preserved at the normal set temperature. By freezing food after introducing the food into the supercooled state as described above, ice crystals are uniformly formed in food, and the food is rapidly cooled after freezing starts and hence, it is possible to suppress enlargement of ice crystals. As a result, the refrigerator 1 can suppress an effect on food quality, such as deterioration of texture of thawed food caused by food cell destruction brought about by freezing of the food and outflow of umami components. That is, the refrigerator 1 can suppress deterioration of texture of thawed food by suppressing food cell destruction, and allows umami components to be maintained. Accordingly, the refrigerator 1 can preserve food in a high quality state even when the food is frozen.

After the user puts food into the versatile compartment 200, the controller 50 automatically starts the special temperature control upon detection of the opening and closing of the versatile compartment door 12 without the user inputting, to the setting operation unit 10, the fact of putting the food into the versatile compartment 200. Therefore, the refrigerator 1 can preserve food in a high quality state without requiring effort. Further, it is possible to prevent a situation in which, after food is put into the versatile compartment 200, the special temperature control is not performed due to the user forgetting to input, to the setting operation unit 10, the fact of putting the food into the versatile compartment 200 after the user puts the food into the versatile compartment 200. In addition to the above, whether the temperature of food is a high temperature is detected by the temperature detection unit 16 detecting the compartment temperature of the versatile compartment 200. The controller 50 automatically starts the special temperature control including rapid cooling and hence, the refrigerator 1 can preserve food in a high quality state without requiring effort from the user, such as briefly cooling down the high temperature food.

Regarding shifting from the second set temperature to the first set temperature, the controller 50 gradually cools the inside of the compartment from the second set temperature to the normal set temperature and hence, fluctuation in the temperature of food in the compartment is suppressed. Therefore, the refrigerator 1 can more stably introduce, into the supercooled state, even food materials, such as chicken, that are less likely to be introduced into the supercooled state. Further, the controller 50 rapidly cools the inside of the compartment from the normal set temperature to the second set temperature and hence, fluctuation in the temperature of food in the compartment increases. Therefore, the refrigerator 1 can surely release the supercooled state of even high lipid food materials, such as dairy products, in which the supercooled state is less likely to be released, that is, freezing is less likely to start.

The controller 50 closes the damper 17*a* after the detection of the opening and closing of the versatile compartment door 12 and hence, intrusion of cold air into the compartment can be prevented, and it is possible to accurately detect a temperature rise in the versatile compartment 200 caused when high temperature food is put into the versatile compartment 200. Further, in the refrigerator 1, intrusion of cold air into the versatile compartment 200 is prevented by the damper 17*a* of the damper device 17 without stopping the cooler 32 or the blower fan 31, the cooler 32 generating cold air for cooling the respective compartments, the blower fan 31 sending, to the respective compartments, the cold air generated by the cooler 32. Therefore, the refrigerator 1 causes no effect, such as stopping of cooling of the respective storage compartments other than the versatile compartment 200 due to the special temperature control, and the controller 50 can accurately detect a temperature rise in the versatile compartment 200.

Further, after the controller 50 detects the opening and closing of the versatile compartment door 12 using the door opening/closing detection unit 19, the controller 50 detects the compartment temperature using the temperature detection unit 16 for a time period ranging from a point of time after the lapse of the first standby time period to the end of the first time period. Thus the refrigerator 1 can suppress an effect of, immediately after the versatile compartment door 12 is closed, the temperature in the compartment rising due to warm air flowing into the compartment from the outside. Accordingly, the controller 50 can more accurately detect a temperature rise in the versatile compartment 200 in the case of high temperature food being put into the versatile compartment 200.

REFERENCE SIGNS LIST

1: refrigerator, 2: heat insulating box body, 2*a*: outer box, 2*b*: inner box, 2*c*: heat insulating material, 10: setting operation unit, 11: refrigerator compartment door 12: versatile compartment door, 13: ice-making compartment door, 14: vegetable compartment door, 15: freezer compartment door, 16: temperature detection unit, 17: damper device, 17*a*: damper, 18: food accommodation case, 19: door opening/closing detection unit, 20: air passage, 21: cooling chamber, 23: partition plate, 30: temperature control unit, 31: blower fan, 32: cooler, 33: compressor, 50: controller, 51: storage device, 100: refrigerator compartment, 200: versatile compartment, 300: ice-making compartment, 400: vegetable compartment, 500: freezer compartment.

The invention claimed is:

1. A refrigerator comprising:

a heat insulating box body having a first storage compartment in the heat insulating box body, the first storage compartment being set to a soft freezing temperature zone;

a door configured to open and close an opening formed at a front side of the first storage compartment;

a door opening/closing detection unit configured to detect opening and closing of the door;

a temperature detection unit configured to detect a compartment temperature of the first storage compartment;

a temperature control unit configured to adjust the compartment temperature of the first storage compartment; and a controller configured to control the temperature control unit based on a detected temperature detected by the temperature detection unit, wherein the controller is configured to perform a special temperature control in which in a case where the controller detects the opening and closing of the door during a normal temperature control in which the compartment temperature of the first storage compartment is maintained at a normal set temperature set in advance, stop, for a first time period set in advance, supply of cold air by the temperature control unit to the first storage compartment, in a case where the controller detects, via the temperature detection unit within the first time period, a temperature rise range equal to or more than a temperature rise range set in advance, cause, by controlling the temperature control unit, the compartment temperature of the first storage compartment to shift to a first set temperature that is lower than the normal set temperature and that is set in advance, and maintain, by controlling the temperature control unit, the first set temperature for a second time period set in advance, after maintaining the first set temperature for the second time period, cause, by controlling the temperature control unit, the compartment temperature of the first storage compartment to shift to a second set temperature that is higher than the normal set temperature and that is set in advance, and maintain, by controlling the temperature control unit, the second set temperature for a third time period set in advance, and after maintaining the second set temperature for the third time period, cause, by controlling the temperature control unit, the compartment temperature of the first storage compartment to shift to the first set temperature, and maintain, by controlling the temperature control unit, the first set temperature for a fourth time period set in advance.

2. The refrigerator of claim 1, wherein detection of the temperature rise range is performed by the temperature detection unit within a time period ranging from a point of time after a lapse of a first standby time period from detection of the opening and closing of the door to an end of the first time period, the first standby time period being shorter than the first time period and being set in advance.

3. The refrigerator of claim 1, wherein in a case where, in the special temperature control, the controller detects, via the temperature detection unit, no temperature rise range equal to or more than the temperature rise range set in advance within a time period ranging from a point of time after a lapse of a first standby time period from detection of the opening and closing of the door to an end of the first time period, the first standby time period being shorter than the first time period and being set in advance, the controller performs no control of the temperature control unit, the controller causes the compartment temperature of the first storage compartment to shift to the second set temperature that is higher than the normal set temperature and that is set in advance, and the controller maintains, by controlling the temperature control unit, the second set temperature for the third time period set in advance, and after the controller maintains the second set temperature for the third time period, the controller causes, by controlling the temperature control unit, the compartment temperature of the first storage compartment to shift to the first set temperature, and maintains, by controlling the temperature control unit, the first set temperature for the fourth time period set in advance.

4. The refrigerator of claim 1, wherein the heat insulating box body has an air passage that communicates a cooling chamber with the first storage compartment, a cooler being disposed in the cooling chamber, cold air cooled by the cooler being fed into the first storage compartment through the air passage, the temperature control unit is a damper device installed in the air passage, and the damper device includes a damper configured to open and close the air passage with control from the controller.

5. The refrigerator of claim 4, wherein in a case where, in the special temperature control, the controller detects the opening and closing of the door during the normal temperature control, the controller brings the damper of the damper device into a closed state for the first time period, and in a case where the controller detects, via the temperature detection unit, the temperature rise range equal to or more than the temperature rise range set in advance, the controller cause the compartment temperature of the first storage compartment to shift to the first set temperature by opening the damper of the damper device.

6. The refrigerator of claim 1, wherein the soft freezing temperature zone is a temperature zone being a range from −4 degrees C. to −10 degrees C.

* * * * *